US005826308A

United States Patent [19]

Chang

[11] Patent Number: 5,826,308

[45] Date of Patent: Oct. 27, 1998

[54] BUNDLING STRAP ASSEMBLY

[76] Inventor: Kun-sheng Chang, No. 25, Lane 59, Chungcheng Rd., Luchou Hsiang, Taipei Hsien, Taiwan

[21] Appl. No.: 675,617

[22] Filed: Jul. 3, 1996

[51] Int. Cl.[6] ..... B65D 63/00

[52] U.S. Cl. ..... 24/16 PB; 248/74.3; 24/30.5 P

[58] Field of Search ..... 24/16 PB, 16 R, 24/17 AP, 30.5 P, 484; 248/74.3

[56] References Cited

U.S. PATENT DOCUMENTS

| | | | |
|---|---|---|---|
| 4,225,103 | 9/1980 | Pate | 248/74.3 |
| 4,573,242 | 3/1986 | Lankton et al. | 24/16 PB |
| 4,680,834 | 7/1987 | Andre et al. | 24/16 PB |
| 4,908,911 | 3/1990 | Bretti et al. | 24/16 PB |
| 5,193,254 | 3/1993 | Geisinger | 24/16 PB X |
| 5,208,948 | 5/1993 | Nirei | 24/16 PB |
| 5,224,244 | 7/1993 | Ikeda et al. | 24/16 PB |
| 5,295,285 | 3/1994 | Shely | 24/16 PB |
| 5,377,388 | 1/1995 | DeBever | 24/16 PB |
| 5,379,494 | 1/1995 | Shirakawa | 24/16 PB |
| 5,440,786 | 8/1995 | Sorensen et al. | 24/16 PB |
| 5,513,421 | 5/1996 | Wells | 24/16 PB |

*Primary Examiner*—Peter M. Cuomo
*Assistant Examiner*—Robert J. Sandy
*Attorney, Agent, or Firm*—James W. Kayden, Esq.; Thomas, Kayden, Horstemeyer & Risley, LLP

[57] ABSTRACT

A bundling strap assembly includes a strap for surrounding articles to be packed and a buckle for securing the strap. The strap has two rows of through holes defined along a longitudinal direction of the strap, a reinforcement rib formed between the two rows of the through holes and a plurality of bosses formed on both major surfaces of the strap for engaging with the articles to be packed. The buckle has a central through opening defined therein and two latching elements resiliently and respectively connected to two opposite inner faces defining the through opening. Each of the two latching elements is connected to the corresponding inner face at one end thereof and has two rows of single direction teeth protruding inward from an inner surface thereof to engage with the through holes defined at two ends of the strap and thereby securing the strap.

2 Claims, 3 Drawing Sheets

BUNDLING STRAP ASSEMBLY

BACKGROUND OF THE INVENTION

1. Field of the Invention

The present invention relates to a bundling strap assembly used with a bundling strap dispenser for packing articles and, more particularly, to an improved bundling strap assembly which is free of the strap's orientation and can very firmly hold the articles to be packed together.

2. Description of Related Art

A conventional bundling strap assembly, as shown in FIG. 3, generally comprises a strap 40 having a series of recesses 42 defined at one side thereof and along a longitudinal direction thereof, and a buckle 44 having two single direction teeth elements 46 respectively formed on opposite inner faces of a central through opening 45 defined in the buckle 44 for engaging with the recesses 42 located at two ends of the strap 40 to thereby secure the strap 40 and hold the articles to be packed.

Because only one side of the bundling strap has recesses defined therein, special attention is needed, when using this type of bundling trap assembly to pack articles, to make sure that the recessed side at both ends of the strap faces respective single direction teeth elements to ensure an effective buckling. Thus, if an orientation of either one of the two ends of the buckling strap is not correctly tracked, it may cause a failure of the buckling and undesired damage to the articles to be packed.

Furthermore, since the side of the bundling strap for engaging with the articles to be packed is smooth in nature, the bundling strap cannot create frictional engagement with the article which is sufficient to be able to firmly hold the articles together.

The present invention provides an improved bundling strap assembly to mitigate and/or obviate the aforementioned problem.

SUMMARY OF THE INVENTION

The present invention provides a bundling strap assembly which includes a strap having two rows of through holes along a longitudinal direction of the strap, a reinforcement rib formed between the two rows of the through holes and a plurality of bosses formed on both major sides of the strap which are used to engage with the articles to be packed by the present invention, and a buckling means for securing the strap which has two latching elements resiliently and respectively connected to two opposite inner faces of a central through opening defined therein.

In accordance with one aspect of the present invention, each of the two latching elements is connected to the corresponding inner face at one end thereof and has two rows of single direction teeth protruding inward from an inner surface thereof to be received in the through holes of the strap.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
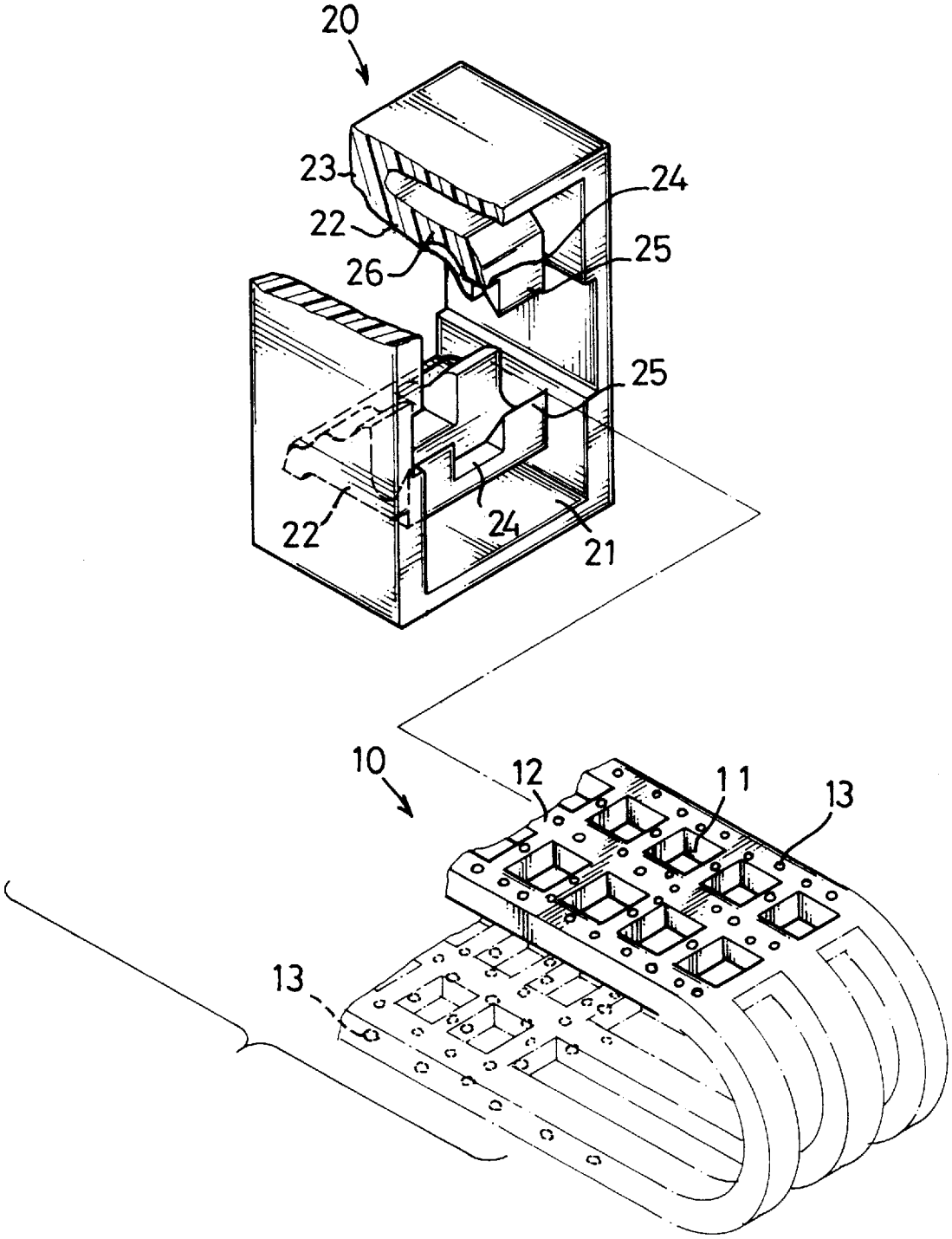
FIG. 1 is a perspective view of a bundling strap assembly in accordance with the present invention with a portion of the buckle being cut-away.

Referring to the drawings and initially to FIG. 1, the bundling strap assembly in accordance with the present invention generally includes a strap 10 and a buckling means 20. The strap 10 comprises two rows of rectangular through holes 11 along a longitudinal direction of the strap 10, a reinforcement rib 12 formed between the two rows of the through holes 11 and a plurality of bosses 13 formed on both major sides of the strap 10 (better seen in FIG. 2). The major sides of the strap 10 are used to engage with the articles 30 to be packed by the bundling strap assembly in accordance with the present invention.

The buckling means 20 comprises a central through opening 21 defined therein and two latching elements 22 resiliently and respectively extending from two opposite inner faces defining the through opening 21. Preferably, each of the latching elements 22 is connected to the corresponding inner face of the through opening 21 at one end 23 thereof such that it can be resiliently pushed slightly outward at the other end 24 thereof. Further, each of the latching elements 22 preferably has two rows of single direction teeth 25 protruding inward from an inner surface 26 thereof.

Figure 2:
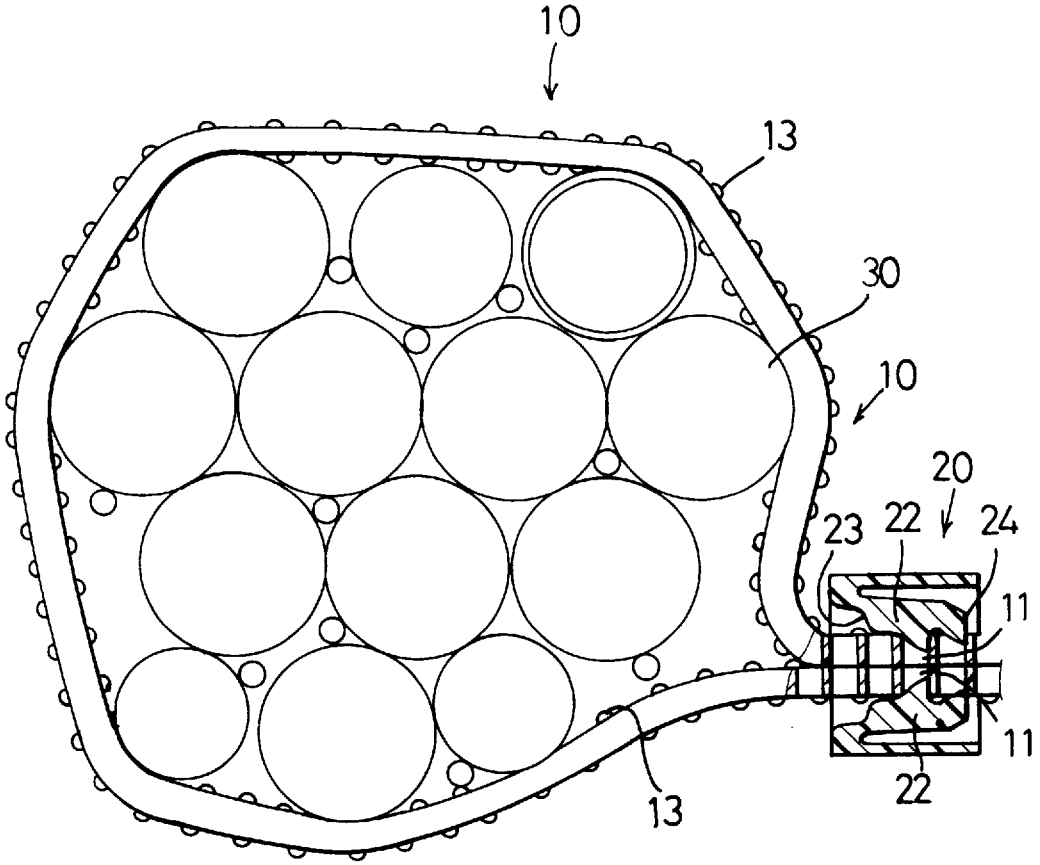
FIG. 2 is a side elevational view, partly in section, of an assembled bundling strap assembly according to the present invention.
Figure 3:
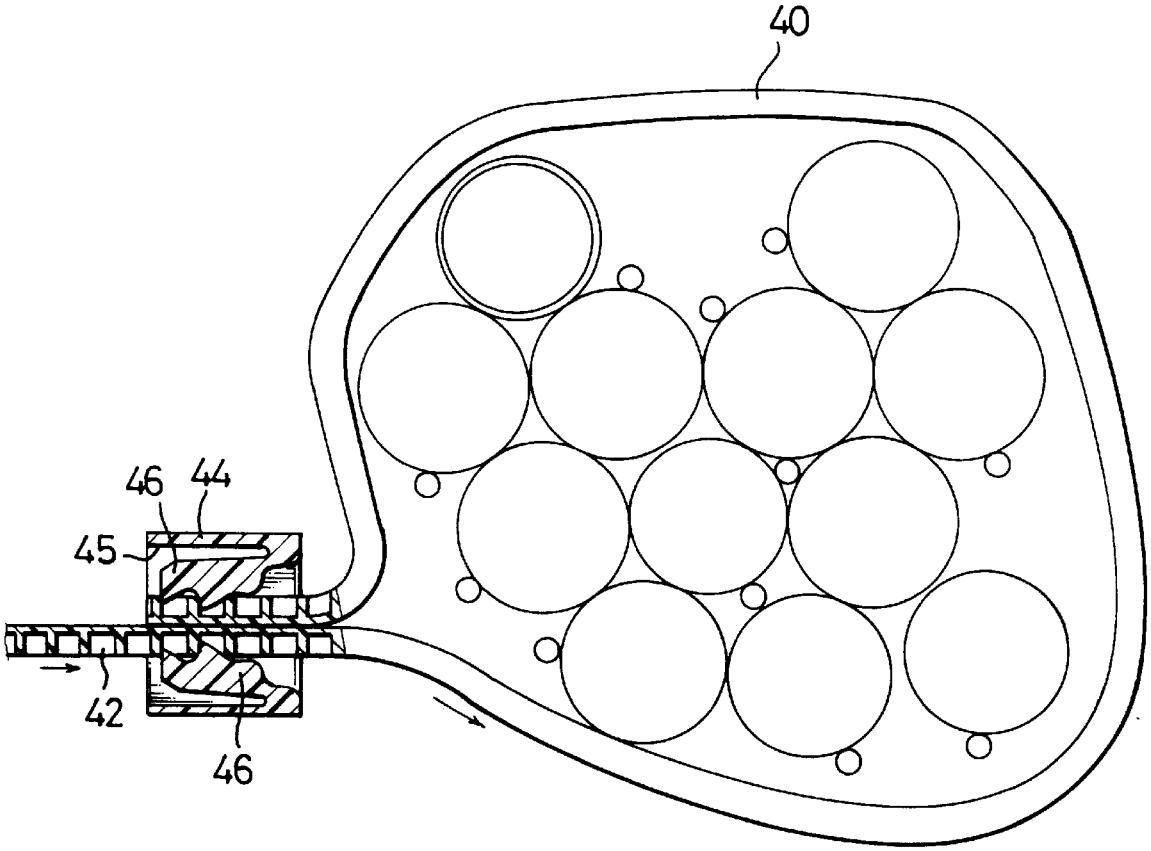
FIG. 3 PRIOR ART
FIG. 3 is a side elevational view, partly in section, of an assembled known bundling strap assembly.

In use, as shown in FIG. 2, one end of the strap 10 is inserted into the through opening 21 of the buckling means 20 in a direction from the end 23 to the end 24 of the latching elements 22 and pressed against one of the latching elements 22 to make the single direction teeth 25 of the latching elements 22 extend into the through holes 11 at this end. Then, the strap 10 is circled around the articles 30 to be packed and the other end of the strap 10 is inserted through the buckling means 20 in a direction from the end 23 to the end 24 of the latching elements 22. The strap 10 is then pulled to tighten up the articles 30 and the single direction teeth 25 of the other latching elements 22 will extend into the through holes 11 which are retained in the buckling means 20 because the distance between the single direction teeth 25 of the two latching element 22 is smaller than twice the thickness of the strap 10. Since the single direction teeth 25 prohibit a movement of the strap 10 in a direction from the end 24 to the end 23 of the latching elements 22, thereby the strap 10 is prevented from becoming loosened.

When the strap 10 is pulled to tighten up the articles 30, the bosses 13 formed on one (or possibly both) of the major sides of the strap 10 will engage with the articles 30 to be packed to create a frictional engagement therewith thereby to firmly hold the articles 30 together.

Although the invention has been explained in relation to its preferred embodiment, it is to be understood that many other possible modifications and variations can be made without departing from the spirit and scope of the invention as hereinafter claimed.

I claim:

1. A bundling strap assembly comprising:

a strap for surrounding articles to be packed, the strap having two rows of through holes defined along a longitudinal direction of the strap, a reinforcement rib formed between the two rows of the through holes and a plurality of bosses formed on two major sides of the strap either of which may be in contact with the articles to be packed; and a buckling means for securing the strap, the buckling means having a central through opening defined therein and two latching elements resiliently and respectively connected to two opposite inner faces defining the through opening, wherein each of the two latching elements is connected to the corresponding inner face at one end thereof and has two rows of single direction teeth protruding inward from an inner surface thereof to be received in the through holes of the strap.

2. The bundling strap assembly as claimed in claim 1, wherein the holes are rectangular in shape.

* * * * *